US010715908B2

(12) United States Patent
Winton et al.

(10) Patent No.: US 10,715,908 B2
(45) Date of Patent: Jul. 14, 2020

(54) ADJUSTABLE ACOUSTIC INTERFACE LOUDSPEAKER

(71) Applicant: Harman International Industries, Incorporated, Stamford, CT (US)

(72) Inventors: Riley Winton, Canton, MI (US); David Mossington, Novi, MI (US); Chris Ludwig, Birmingham, MI (US); Christopher Michael Trestain, Livonia, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/234,416

(22) Filed: Dec. 27, 2018

(65) Prior Publication Data

US 2019/0246202 A1 Aug. 8, 2019

Related U.S. Application Data

(60) Provisional application No. 62/612,001, filed on Dec. 29, 2017.

(51) Int. Cl.

| | |
|---|---|
| ***H04R 1/02*** | (2006.01) |
| ***H04R 1/32*** | (2006.01) |
| ***H04R 1/34*** | (2006.01) |
| ***H04R 1/28*** | (2006.01) |

(52) U.S. Cl.

CPC ..... *H04R 1/323* (2013.01); *H04R 1/2803* (2013.01); *H04R 1/345* (2013.01); *H04R 1/021* (2013.01); *H04R 2201/025* (2013.01)

(58) Field of Classification Search

CPC . H04R 1/02; H04R 1/021; H04R 1/20; H04R 1/28; H04R 1/2803; H04R 1/323; H04R 1/34; H04R 1/345; H04R 2201/025

USPC ..... 381/337, 338, 339, 340, 341, 345, 350, 381/358, 162, 386, 387, 411

See application file for complete search history.

(56) References Cited

U.S. PATENT DOCUMENTS

| | | | | |
|---|---|---|---|---|
| 4,227,051 | A | 10/1980 | Thomas et al. | |
| 5,838,537 | A | 11/1998 | Lundgren et al. | |
| 2005/0123156 | A1* | 6/2005 | Wright ..... | H04R 1/025 381/182 |
| 2005/0263341 | A1 | 12/2005 | Minneci | |
| 2015/0086035 | A1 | 3/2015 | Shin | |
| 2019/0306616 | A1* | 10/2019 | Enenkl ..... | H04R 9/063 |

FOREIGN PATENT DOCUMENTS

| | | |
|---|---|---|
| CN | 201904890 | 7/2011 |
| EP | 2181895 | 5/2010 |

* cited by examiner

*Primary Examiner* — Walter F Briney, III
(74) *Attorney, Agent, or Firm* — McCoy Russell LLP

(57) ABSTRACT

The present disclosure relates to loudspeakers and loudspeaker configurations. In one embodiment, a loudspeaker includes a driver, a basket structure and an acoustic interface surrounding the driver. The outer portion of the acoustic interface can be supported by the basket structure. Loudspeaker configurations provided herein can include a positioning element configured to position the driver in at least one of a first position relative to the basket structure, and a second position relative to the basket structure. Other embodiments are directed to loudspeaker components and configurations. In one embodiment, loudspeaker includes a housing structure and a flexible (e.g., stretch) acoustic interface to surround a driver of the loudspeaker.

20 Claims, 6 Drawing Sheets

ADJUSTABLE ACOUSTIC INTERFACE LOUDSPEAKER

CROSS-REFERENCE TO RELATED APPLICATION

This application claims priority to U.S. Provisional Application No. 62/612,001 filed on Dec. 29, 2017 and titled ADJUSTABLE ACOUSTIC INTERFACE LOUDSPEAKER, the content of which is expressly incorporated by reference in its entirety.

FIELD

The present disclosure relates to audio output devices, and more particularly to loudspeakers having adjustable acoustic interfaces.

BACKGROUND

Loudspeakers are usually configured for operation in a fixed position. In addition, designers typically select a speaker configuration for a particular use. It can be very difficult to change acoustic properties without complete change of the speaker for many applications. By way of example, vehicle speaker mounting positions and configurations can be troublesome to implement due to time, packaging, mass, or other similar constraints. Moreover, once configured, these mounting positions and acoustical interfaces are often permanently fixed, thus reducing the loudspeaker's flexibility to one, or a rather limited set, of use cases. The degradations from some acoustical interfaces usually appear as poorly performing spatial/directivity loudspeaker characteristics, or other high-Q (sharp) frequency based effects. These issues are predicated purely by acoustics and physics and therefore cannot be undone with electrical equalization or any other software techniques. There exists a desire for loudspeaker configurations with improved and adjustable acoustic output.

SUMMARY

Disclosed and claimed herein are loudspeaker configurations. One embodiment is directed to a loudspeaker including a driver, a basket structure, and an acoustic interface surrounding the driver. The outer portion of the acoustic interface is supported by the basket structure. The loudspeaker includes a positioning element configured to position the driver in at least one of a first position relative to the basket structure, and a second position relative to the basket structure.

In one embodiment, the acoustic interface is a baffle material configured to provide a surface for at least one of a flat baffle and horn interface.

In one embodiment, the positioning element is at least one of a linear actuator and multiple motion actuator.

In one embodiment, the positioning element is configured to adjust at least one of position and direction of the driver.

In one embodiment, the first position is a flat arrangement of the acoustic interface element.

In one embodiment, the positioning element is configured to retract the driver from the first position to a second position to form a horn configuration for the acoustic interface.

In one embodiment, the acoustic interface is secured to the basket structure by a gasket element.

In one embodiment, the acoustic interface is configured to conform to an inner surface of the basket structure when retracted into the basket structure.

In one embodiment, a first position relative to the basket structure is a baffle configuration for the acoustic interface, and the second position relative to the basket structure is a horn configuration for the acoustic interface.

In one embodiment, the loudspeaker includes a housing structure formed with the basket structure, wherein the housing structure is configured to house the positioning element.

One embodiment is directed to loudspeaker including a driver, a housing structure and a flexible acoustic interface surrounding the driver, wherein the outer portion of the flexible acoustic interface is by the housing structure. The loudspeaker includes a positioning element configured to position the driver in at least one of a first position relative to the housing structure, and a second position relative to the housing structure.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1B:
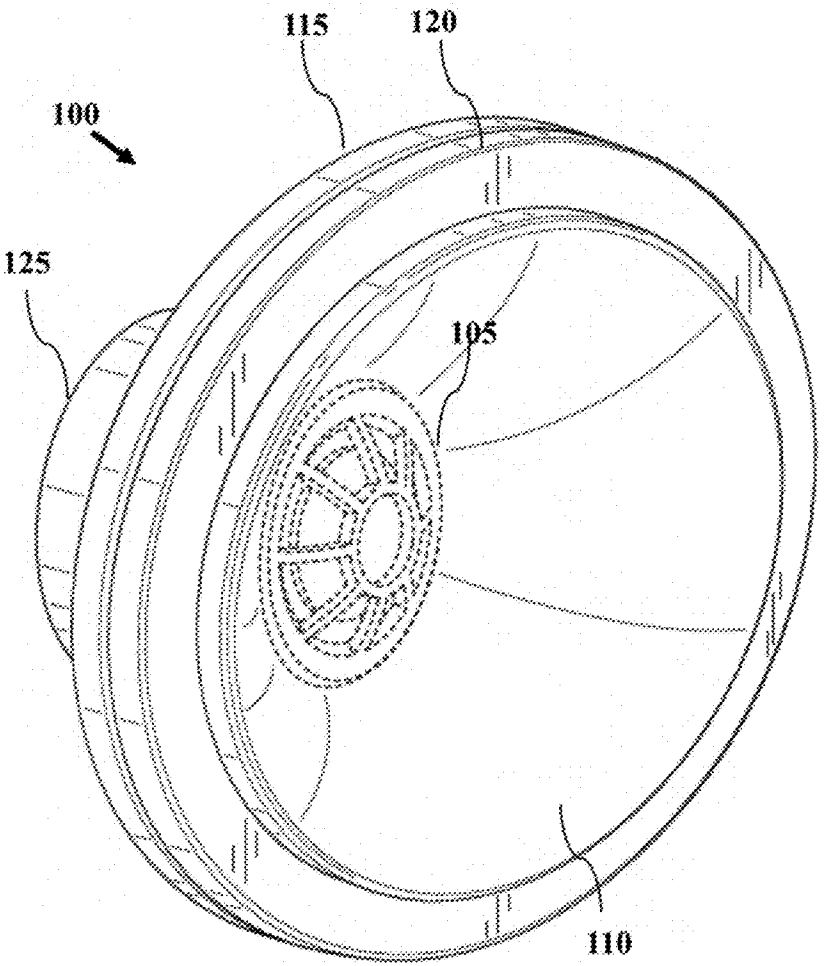
FIGS. 1A-1B depict a loudspeaker according to one or more embodiments.

One aspect of the disclosure is directed to a loudspeaker mechanism to provide an adjustable acoustic interface for a loudspeaker. Embodiments are discussed herein for one or more loudspeaker architectures. By way of example, loudspeaker configurations are provided including a driver having one or more positions relative to a housing structure (e.g., basket structure) of the loudspeaker and a flexible acoustic interface to adjust with driver adjustment. In one embodiment, the acoustic interface may be configured to provide a flat baffle configuration and a horn configuration. Embodiments of the disclosure allow for multiple acoustic sound configurations from the same loudspeaker device.

One embodiment is directed to a loudspeaker having a driver, a housing structure, and an acoustic interface surrounding the driver. The housing structure may be a basket structure having an interior space to allow for positioning of the driver and one or more movable elements. The acoustic interface may surround the driver and an outer portion of the acoustic interface is secured by the basket structure. The positioning element may be configured to position the driver in at least one of position relative to the basket structure. Positioning of the driver element may include adjustment relative to the direction of the driver and/or retraction of the driver element.

Another embodiment is directed to a loudspeaker having an adjustable acoustic interface for a driver. The acoustic interface is a baffle material configured to provide a surface for at least one of a flat baffle and horn interface.

Embodiments are directed to loudspeaker configurations and components. In one embodiment, a loudspeaker includes a housing structure and one or more adjustable elements.

Another embodiment is directed to providing a moving mechanism for an adjustable acoustic interface. A loudspeaker as discussed herein may include a movable element, such as a mechanized configuration to adjust an acoustical interface of a loudspeaker. The moveable element may include one or more drive elements, such as a motorized assembly to move a loudspeaker, loudspeaker housing, or surrounding acoustical interface substrate to portray one or several optimized acoustical interfaces. In one exemplary embodiment, a tweeter can be mounted in a cylinder with a stretchable material (e.g., silicone, rubber, stretch material in general, etc.) existing as the loudspeaker baffle. The speaker can then be moved backwards, thus stretching the baffle material over a given form, providing the loudspeaker with a specific horn or waveguide acoustical interface. One benefit of the arrangement may be to provide loudspeaker directivity. For example, a loudspeaker can be placed in a traditional baffled mounting position for a standard audio experience, and/or the speaker can be retracted in a tube- or horn-like acoustical interface to control directivity in an isolated audio experience setting.

Embodiments and configurations discussed herein can overcome one or more drawbacks of vehicle speaker mounting positions and configurations that may be troublesome to implement due to time, packaging, mass, or other similar constraints. Additionally, some use cases in a vehicle may require completely opposite speaker acoustical interfaces. Embodiments discussed herein provide solutions to meet many requirements without adding loudspeakers.

Embodiments are directed to adjusting loudspeaker output (e.g., inherent acoustical properties, etc.) to modular and adjustable system. More specifically, embodiments are directed to directing the influence of the loudspeaker's acoustical interface to the vehicle cabin.

Although loudspeaker configurations are discussed herein with respect to certain applications, it should be appreciated that the loudspeaker configurations discussed herein may be applied to other devices and for additional applications.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1A:
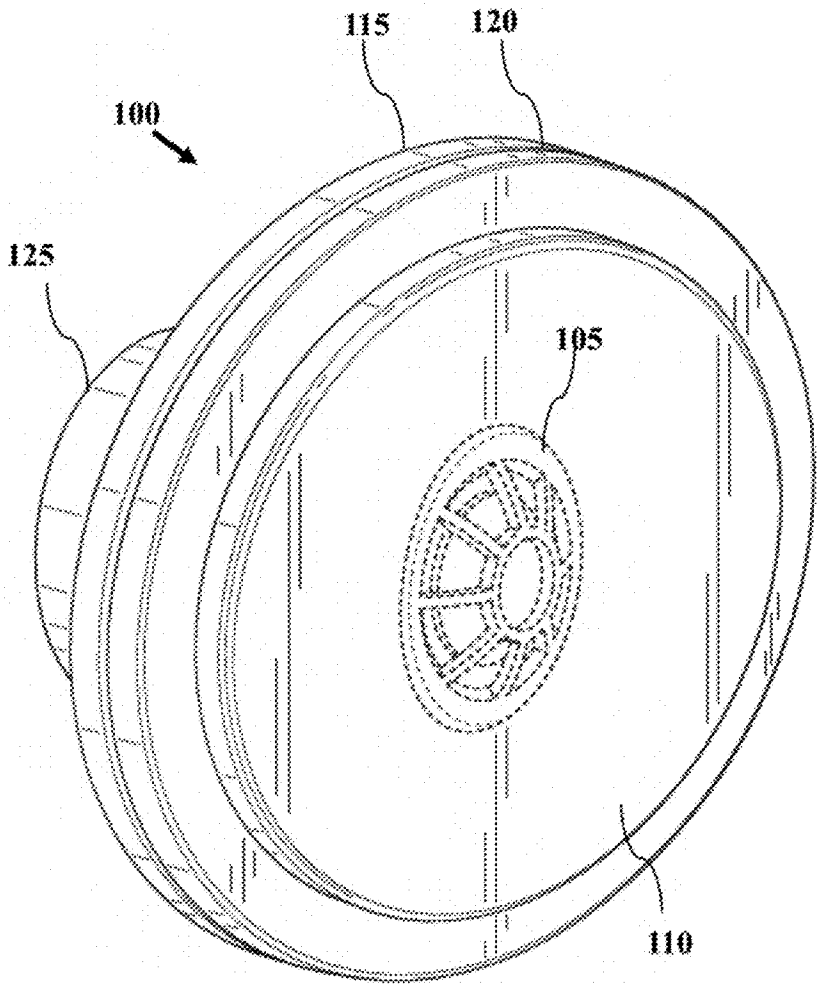

FIGS. 1A-1B depict a loudspeaker according to one or more embodiments. Referring first to FIG. 1A, loudspeaker 100 includes driver 105, acoustic interface 110, and housing structure 115. According to one embodiment, acoustic interface 110 of loudspeaker 100 is configured to provide a plurality of acoustic sound profiles. In FIG. 1A, acoustic interface 110 is shown in a first position. In one embodiment, the first position may be a flat arrangement of acoustic interface 110. According to another embodiment, at least one of driver 105 and acoustic interface 110 may be adjusted by way of movement and/or redirection. FIG. 1A depicts acoustic interface 110 in a baffle configuration according to one or more embodiments. Acoustic interface 110 may be moved to one or more other positions and adjustment may include changing direction of driver 105.

According to one embodiment, acoustic interface 110 is a baffle material configured to provide a surface for at least one of a flat baffle and horn interface. As will be discussed herein, acoustic interface 110 relates to a flexible or stretchable material configured for adjustment and to modify its shape to provide at least one acoustic profile based on adjustment of driver 105. Exemplary materials of acoustic interface 110 include vinyl, silicone, and other fabric materials. Driver 105 may relate to a dynamic speaker, such as a tweeter, according to one or more embodiments.

According to one embodiment, loudspeaker 100 provides a structural configuration for a loudspeaker. Loudspeaker 100 is shown having a generally oval outer shape. Housing structure 115 may be a basket structure for loudspeaker 100. Gasket 120 is configured to retain acoustic interface 110, and in particular an outer portion of acoustic interface 110, to housing structure 115. The inner portion of acoustic interface 110 may be coupled or retained to the outer portion of driver 105. Acoustic interface 110 may be secured to the housing structure 115, which may relate to a basket structure, by gasket 120. Loudspeaker 100 may also include back plate 125.

FIG. 1B shows acoustic interface 110 in a second position. According to one embodiment, the second position is associated with adjustment of driver 105 to a retracted position and adjustment of acoustic interface 110. According to one embodiment, acoustic interface 110 may be coupled to the outer portion of driver 105, and/or one or more elements supporting driver 105. In certain embodiments, loudspeaker 100 includes structural elements behind acoustic interface 110 as will be shown in FIGS. 2A-2B, which may allow for supporting the inner portion of acoustic interface 110. According to one embodiment, acoustic interface 110 conforms to an inner wall of housing structure 115 when driver 105 is retracted.

Figure 2A:
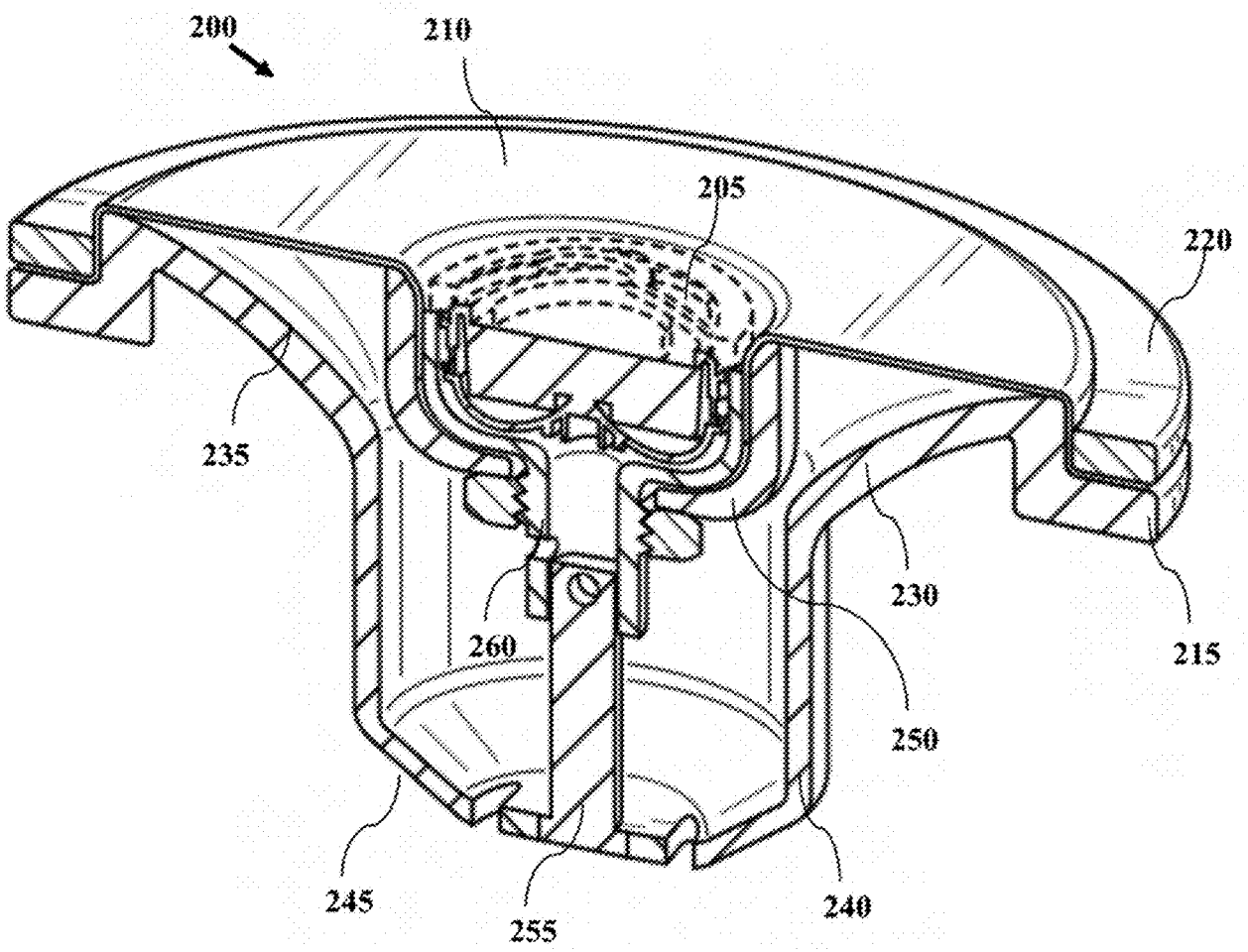
FIGS. 2A-2B depicts cross-sectional views of a loudspeaker according to one or more embodiments.
Figure 2B:
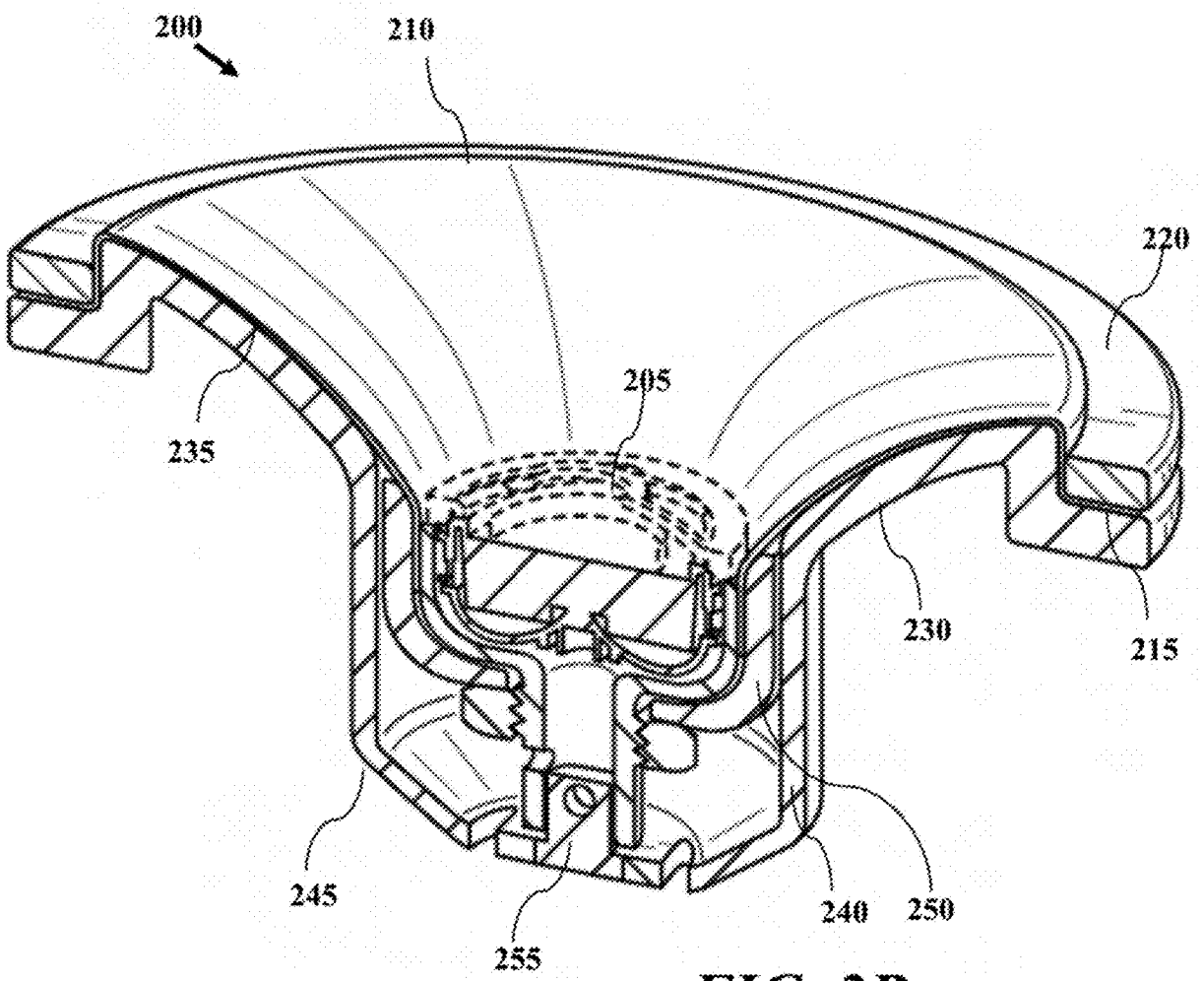

FIGS. 2A-2B depicts cross-sectional views of a loudspeaker according to one or more embodiments. According to one embodiment, loudspeaker 200 may relate to a cross-sectional representation of loudspeaker 100 of FIGS. 1A-1B.

Loudspeaker 200 includes driver 205, acoustic interface 210, and housing structure 215. Acoustic interface 210 of loudspeaker 200 may be retained between gasket 220 and housing structure 215. Housing structure 215 includes horn section 230 having an inner wall 235, cylindrical portion 240 and base 245 which may be a back plate. According to one embodiment, driver 205 may be positioned by moveable element 255 including mount 260. Mount 260 may be coupled to driver 205. At least one of moveable element 255 and mount 260 may allow for multi-direction movement of driver 205 and thus, provide adjustment of acoustic interface 210. According to one embodiment, housing structure 215 is configured to allow for vertical and directional movement (e.g., tilt, etc.) within the housing. In addition, inner wall 235 of housing structure 215 may interface with acoustic interface 210 when driver 205 is positioned. Driver support 250 for example may be configured to retain driver 205 and an inner portion of acoustic interface 210. In addition, driver support 250 may interface with moveable element 255 and mount 260. Moveable element 255 may be a positioning element such as one of a linear actuator and multiple motion actuator. Moveable element 255 may be configured to adjust at least one of position and direction of driver 205. For example, moveable element 255 may be configured to adjust loudspeaker 200 into a flat arrangement of the acoustic interface element. Similarly, moveable element 255 may be configured to adjust loudspeaker 200 to retract driver 205 to a second position to form a horn configuration for acoustic interface 210. Loudspeaker 200 provides an acoustic output configuration in the arrangement of driver 205 in a baffle position in FIG. 2A.

FIG. 2B is a cross sectional representation of loudspeaker 200 in a second position. according to one or more embodiments. In FIG. 2B, driver 205 is adjusted to be lower within housing structure 215 such that acoustic interface 210 is in contact with inner wall 235. In addition, acoustic interface forms a horn shaped surface for driver 205 resulting in a different acoustic output configuration for loudspeaker 200 relative to the baffle arrangement of FIG. 2A. Acoustic interface 210 is configured to conform to inner wall 235, which may be an inner surface of a basket structure, when retracted into the housing structure. According to another embodiment, FIG. 2A may show a first position relative to a basket structure as a baffle configuration for the acoustic interface 210, while FIG. 2B may show a second position relative to a basket structure as a horn configuration for the acoustic interface 210. Housing structure 215 may be formed with a basket structure and may also be configured to house a positioning element for driver 205.

Acoustic interface 210 may be silicone configured to conform to the horn shape of housing 215 when pulled back. According to one embodiment, the further back acoustic interface 210 retracts, the further toward the center area of the horn the acoustic interface conforms. For example, halfway retracted would simply bridge across some point along the horn shape toward a central tweeter assembly of driver 205.

Figure 3A:
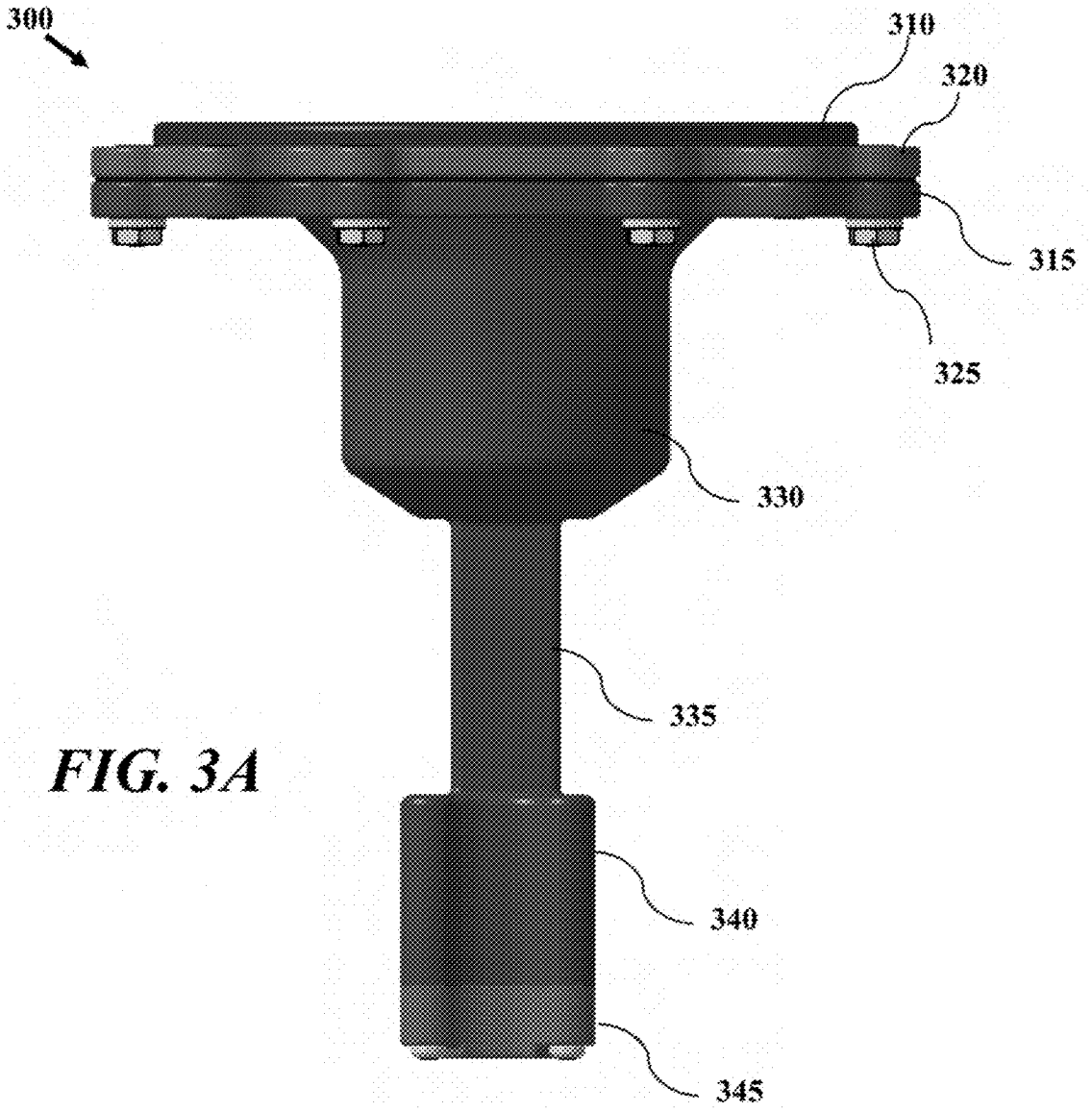
FIGS. 3A-3C depict graphical representations of a loudspeaker according to one or more embodiments.
Figure 3C:
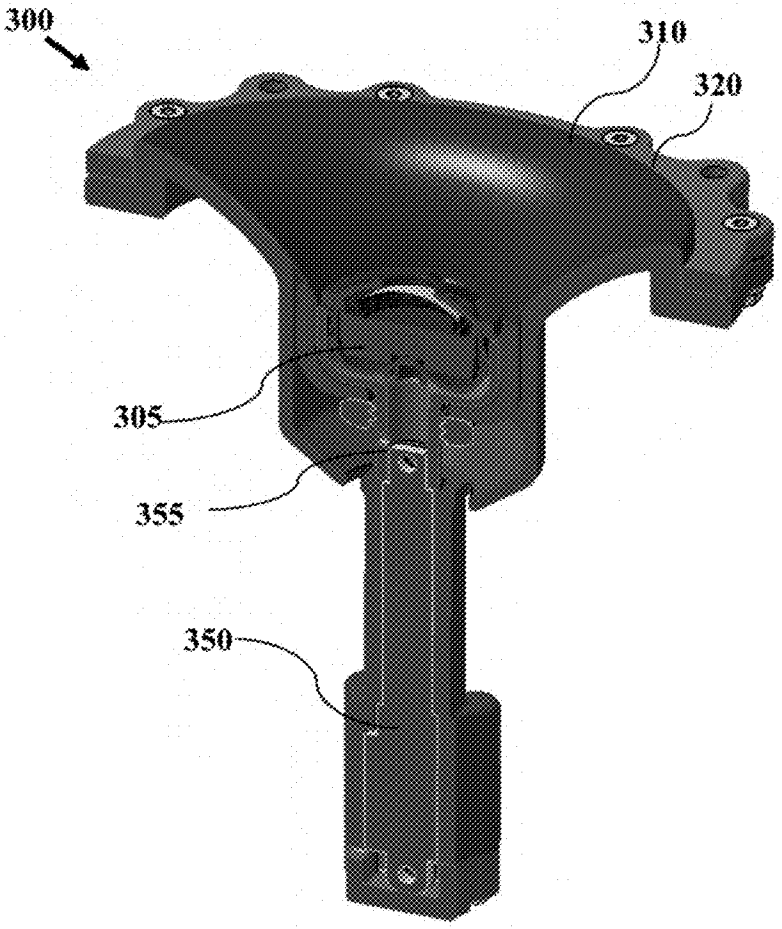
Figure 3B:
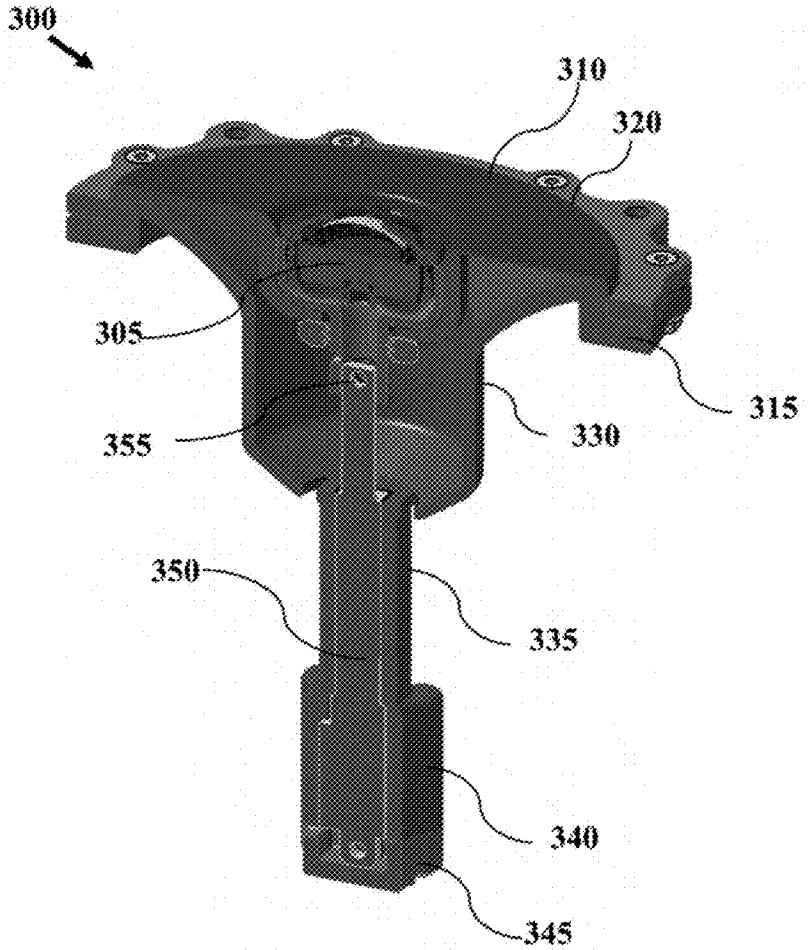

FIGS. 3A-3C depict graphical representations of a loudspeaker according to one or more embodiments. Loudspeaker 300 includes acoustic interface 310, housing structure 315 and gasket 320. Acoustic interface 310 of loudspeaker 300 may be retained between gasket 320 and housing structure 315 by one or more fasteners, such as fastener 325. Housing structure 315 includes horn section 330, actuator shaft portion 335, actuator body portion 340 and base 345. According to one embodiment, horn section 330 of housing structure 315 includes a an inner surface that may be curved and/or include one or more curved portions to allow the driver element of loudspeaker 300 to be positioned and/or directed within the horn section 330.

According to one embodiment, housing structure 315 includes an elongated selection formed by actuator shaft portion 335, actuator body portion 340 and base 345 to house an actuator for position of a driver element of loudspeaker 300. Actuator shaft portion 335 extends from the base of horn section 330 to house a linear actuator. Actuator body portion 340 is configured to house one or more drive elements, gear motors, etc. Base 345 may be removed to allow for installation, replacement and servicing of a drive element.

FIG. 3B depicts a cross-sectional view of loudspeaker 300 including actuator element 350 having end 355 mounted to at least one of driver 305 of loudspeaker 300 and driver mount. In FIG. 3B, loudspeaker 300 is configured in a first position, or baffled position with actuator 350 extended. In FIG. 3C, loudspeaker is shown in a second position with actuator pulling driver 305 and adjusting acoustic interface 310. Acoustic interface 310 conforms with an inner surface of housing structure, such as an inner surface of horn section 330. As shown in FIGS. 3A-3C, actuator shaft portion 335 is elongated to allow for the actuator to extend and retract.

FIGS. 4A-4D depict graphical representations of loudspeaker operation according to one or more embodiments. According to one embodiment, a driver of a loudspeaker may be adjusted in one or more positions and directions by an actuator. Structural elements of the loudspeaker allow for adjustment of the driver, such as an acoustic interface (e.g., acoustic interface 110) to provide a plurality of acoustic sound configurations and control directivity.

Figure 4A:
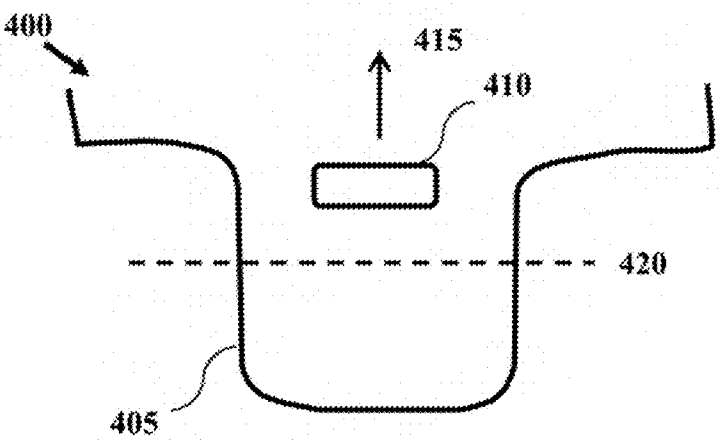
FIGS. 4A-4D depict graphical representations of loudspeaker adjustment according to one or more embodiments.
Figure 4B:
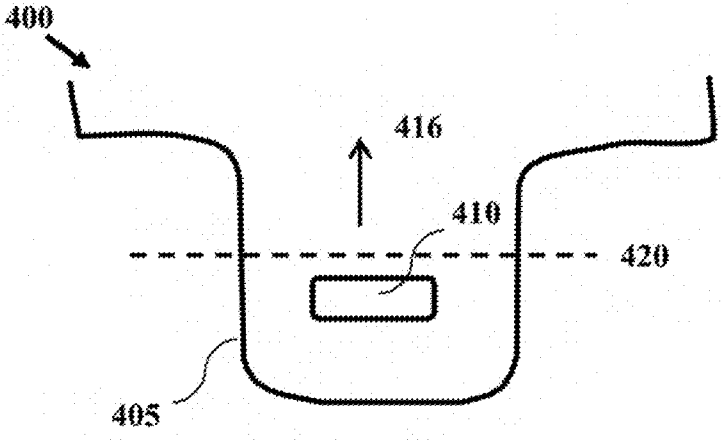

FIG. 4A shows loudspeaker 400 including a basket structure 405 and driver 410 arranged in a first position. Driver 410 is facing forward, as shown by direction 415. Reference line 420 is shown in FIGS. 4A-4B as a point of reference for position of driver 410 relative to basket structure 405. Direction 415 is forward direction. FIG. 4B shows driver 410 adjusted to be retracted within basket structure 405, such that driver 410 is retracted below reference line 420. In FIG. 4B, driver 410 is facing forward direction 415.

Figure 4C:
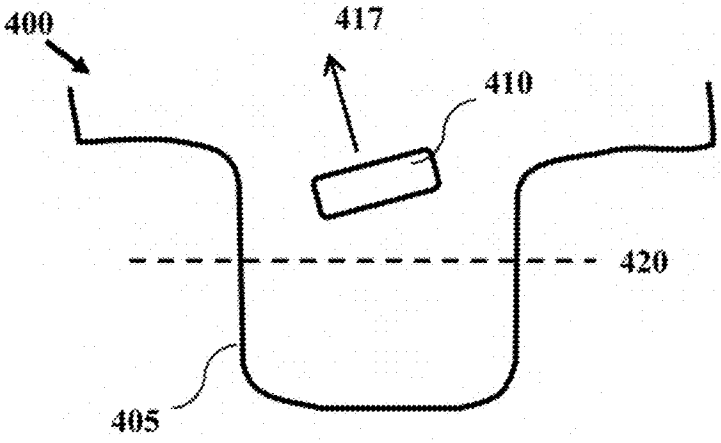
Figure 4D:
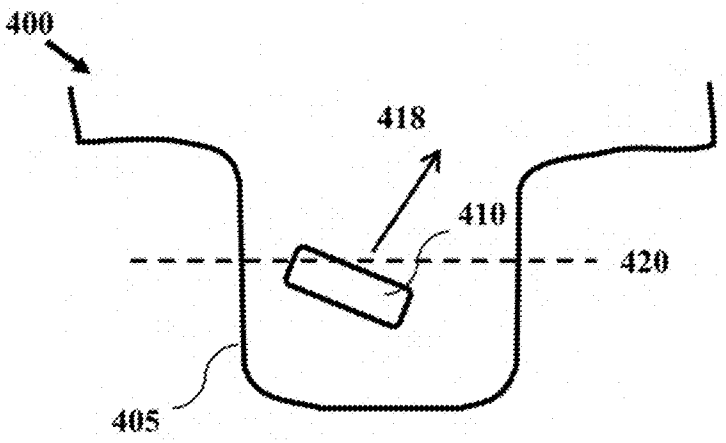

FIG. 4C shows driver 410 adjusted to be facing direction 417 which is offset from direction 415. Accordingly, FIG. 4C depicts adjustment of directionality while maintaining a first position. FIG. 4D shows driver 410 adjusted to be facing direction 418 which is offset from direction 415 and with driver 410 below reference line 420. Accordingly, FIG. 4D depicts adjustment of directionality and retraction within housing structure 405.

While this disclosure has been particularly shown and described with references to exemplary embodiments thereof, it will be understood by those skilled in the art that various changes in form and details may be made therein without departing from the scope of the claimed embodiments.

What is claimed is:

1. A loudspeaker comprising:

a driver;

a basket structure;

an acoustic interface surrounding the driver, wherein the outer portion of the acoustic interface is supported by the basket structure; and a positioning element configured to position the driver in at least one of a first position relative to the basket structure, and a second position relative to the basket structure, wherein the positioning element is at least one of a linear actuator and multiple motion actuator.

2. The loudspeaker of claim 1, wherein the acoustic interface is a baffle material configured to provide a surface for at least one of a flat baffle and horn interface.

3. The loudspeaker of claim 1, wherein the positioning element is configured to position the driver relative to the basket structure including retraction of the driver element.

4. The loudspeaker of claim 1, wherein the positioning element is configured to adjust at least one of position and direction of the driver.

5. The loudspeaker of claim 1, wherein the first position of the driver provides an acoustic output configuration including is a flat arrangement of the acoustic interface element.

6. The loudspeaker of claim 1, wherein the positioning element is configured to retract the driver from the first position to a second position to form a horn configuration for the acoustic interface.

7. The loudspeaker of claim 1, wherein the acoustic interface is secured to the basket structure by a gasket element.

8. The loudspeaker of claim 1, wherein the acoustic interface is configured to conform to an inner surface of the basket structure when retracted into the basket structure.

9. The loudspeaker of claim 1, wherein a first position of the driver relative to the basket structure is a baffle configuration for the acoustic interface, and the second position of the driver relative to the basket structure is a horn configuration for the acoustic interface.

10. The loudspeaker of claim 1, further comprising a housing structure formed with the basket structure, wherein the housing structure is configured to house the positioning element.

11. A loudspeaker comprising:

a driver;

a housing structure;

a flexible acoustic interface surrounding the driver, wherein the outer portion of the flexible acoustic interface is by the housing structure; and a positioning element configured to position the driver in at least one of a first position relative to the housing structure, and a second position relative to the housing structure, wherein the positioning element is at least one of a linear actuator and multiple motion actuator.

12. The loudspeaker of claim 11, wherein the flexible acoustic interface is a baffle material configured to provide a surface for at least one of a flat baffle and horn interface.

13. The loudspeaker of claim 11, wherein the positioning element is configured to position the driver relative to the basket structure including retraction of the driver element.

14. The loudspeaker of claim 11, wherein the positioning element is configured to adjust at least one of position and direction of the driver.

15. The loudspeaker of claim 11, wherein the first position of the driver provides an acoustic output configuration including is a flat arrangement of the flexible acoustic interface element.

16. The loudspeaker of claim 11, wherein the positioning element is configured to retract the driver from the first position to a second position to form a horn configuration for the flexible acoustic interface.

17. The loudspeaker of claim 11, wherein the flexible acoustic interface is secured to the housing structure by a gasket element.

18. The loudspeaker of claim 11, wherein the flexible acoustic interface is configured to conform to an inner surface of the housing structure when retracted into the housing structure.

19. The loudspeaker of claim 11, wherein a first position of the driver relative to the housing structure is a baffle configuration for the flexible acoustic interface, and the second position of the driver relative to the housing structure is a horn configuration for the flexible acoustic interface.

20. The loudspeaker of claim 11, wherein the housing structure is configured to house the positioning element.

* * * * *